United States Patent [19]

Lymburner

[11] Patent Number: 4,879,440

[45] Date of Patent: Nov. 7, 1989

[54] PROXIMITY SWITCH FOR A CYLINDER

[76] Inventor: Robert K. Lymburner, 4085 Clinton Dr., Clinton River Mobile Park, Mt. Clemens, Mich. 48043

[21] Appl. No.: 283,818

[22] Filed: Dec. 13, 1988

Related U.S. Application Data

[63] Continuation-in-part of Ser. No. 141,552, Jan. 7, 1988, Pat. No. 4,803,318.

[51] Int. Cl.[4] ..... H01H 35/38

[52] U.S. Cl. ..... 200/82 R; 73/745; 200/47; 200/81.4; 340/626

[58] Field of Search ..... 200/47, 82 R, 82 C, 200/81.4, 81.5, 302.1, 153; 307/118; 73/745; 340/611, 626; 91/1, 363 R; 92/5 R, 113

[56] References Cited

U.S. PATENT DOCUMENTS

| | | |
|---|---|---|
| Re. 25,257 | 10/1962 | Ellis, Jr. . |
| 3,141,381 | 7/1964 | MacDonald . |
| 3,414,693 | 12/1968 | Watson et al. . |
| 3,524,634 | 8/1970 | Schmidt . |
| 3,654,549 | 4/1972 | Maurer et al. . |
| 3,726,191 | 4/1973 | Johnston et al. . |
| 3,839,608 | 10/1974 | De Vries . |
| 3,937,912 | 2/1976 | Martin . |
| 4,316,145 | 2/1982 | Tann . |
| 4,396,183 | 8/1983 | Lymburner . |
| 4,523,514 | 6/1985 | Burk . |
| 4,656,457 | 4/1987 | Brausfeld et al. . |
| 4,664,364 | 5/1987 | Lymburner . |
| 4,700,610 | 10/1987 | Bauer et al. . |
| 4,803,318 | 2/1989 | Lymburner ..... 200/82 R |

*Primary Examiner*—Gerald P. Tolin
*Attorney, Agent, or Firm*—Basile and Hanlon

[57] ABSTRACT

A proximity switch for signaling the location of a movable member at either of opposite end limits of movement relative to a stationary frame includes a movable member, such as a piston, traveling along a fixed path of movement between a first position and a second position and having an aperture formed within the movable member extending from one end toward another end. A housing encloses a portion of the movable member to form a first fluid chamber between the movable member and a first end of the housing, and to form a second fluid chamber between a second end of the housing and the movable member. Expansion of the first fluid chamber drives the movable member to the first position and expansion of the second fluid chamber drives the movable member to the second position. A sensor-supporting member is connected at one end to the housing with another end extending parallel to the path of travel of the movable member toward the second end of the housing engaged within a non-electrically conductive sleeve fixedly disposed in the aperture of the movable member. Sensor switches are mounted on a non-electrically conductive portion of the sensor-supporting member for sensing the first and second positions of the movable member. The sensor switches are activated by annular electrically conductive contacts disposed on an inner surface of the insulated sleeve disposed within the aperture of the movable member.

18 Claims, 1 Drawing Sheet

PROXIMITY SWITCH FOR A CYLINDER

RELATED APPLICATIONS

This application is a continuation-in-part application from my prior pending application Ser. No. 141,552 filed Jan. 7, 1988, now U.S. Pat. No. 4,803,318.

BACKGROUND OF THE INVENTION

I. Field of the Invention

The invention relates to a proximity switch assembly particularly adapted for use in signaling the location of a movable member.

II. Description of the Prior Art

My prior U.S. Pat. No. 4,664,364 issued on May 12, 1987 discloses a proximity switch assembly for signaling the location of a movable member at either of two opposite end limits of movement relative to a stationary frame. The proximity switch assembly includes a compact, elongate housing adapted to be mounted on the frame to extend along the path of movement of a power-driven member, such as a piston rod, which would shift the movable member between its end limits. A proximity switch is fixedly mounted in the housing and a switch actuating member is mounted for sliding movement over a relatively short distance sufficient to move an actuating tab into and out of actuating proximity to the switch. As the power-driven member approaches one end limit, it slides the switch actuating member within actuating proximity to the switch; and as the power-driven member approaches its opposite end limit, it slides the switch actuating member out of actuating proximity to the switch.

This type of switch assembly is adapted for use in power-actuated clamps of the general type shown in my prior U.S. Pat. No. 4,396,183 issued on Aug. 2, 1983, in which a clamping arm is driven in movement between a closed workpiece clamping position and an open position by the piston rod of a fluid pressure actuated motor. Similar clamps are widely employed in automotive assembly plants to clamp major sheet metal panels, such as roof panels, body side panels and floor panels, in a fixed position while the panels are being welded to each other. In a completely automated system it is essential that all clamps are engaged prior to the welding operation, and the closure of each clamp must be verified by the control system before the robotic welders begin the welding cycle. Similarly, the control system must verify that all clamps are open before the retraction of gates to accommodate the discharge of the welded body from the work station. Substantial operating clearances must be provided in robotic welding systems for movement of several robotic welding heads, which must pass through the clamp carrying gates to reach the seams which are to be welded.

U.S. Pat. No. 4,316,145 discloses a fluid pressure actuator with a proximity position sensor. The proximity position sensor disclosed is a magnetically biased reed switch installed within the cylinder pressure chamber so as to sense the proximity of the piston or a portion of the attached operating rod. Operating circuitry is associated with each proximity switch to provide a delay feature preventing triggering of the associated circuitry upon momentary closing of the reed switch contacts due to mechanical vibrations or other causes. This arrangement requires the cylinder end cap to be modified to provide a mounting for the switch and normally a junction housing must be mounted on the exterior of the cylinder for each proximity switch.

The present invention provides a proximity switch mounted within the cylinder to shield the switch from dirt, weld splatter, etc., which is of extremely compact construction and requires a minimum of structural modification of the fluid pressure actuator.

SUMMARY OF THE INVENTION

The present invention discloses a switch for use with a cylinder including a movable member, such as a piston and attached piston rod, traveling along a fixed path between a first position and a second position. The movable member has a first end, a second end and an aperture extending from the first end parallel to the fixed path of travel toward the second end. A housing is engageable with the movable member to form a first expansible fluid chamber between the reciprocal member and a first end of the housing, and to form a second, independent, expansible fluid chamber between the movable member and a second end of the housing. Expansion of the first fluid chamber drives the movable member to the first position, and expansion of the second fluid chamber drives the movable member to the second position. A sensor-supporting member is connected to one end of the housing and is engageable within an electrically insulated sleeve disposed in the aperture of the movable member. Sensor means are mounted on an electrically insulated portion of the sensor-supporting member for sensing the movable member in the first position. Contact means are provided on an inner surface of the insulating sleeve within the movable member for activating the sensor means. Second sensor means can also be provided mounted on the insulated portion of the sensor-supporting member for sensing the movable member in the second position. Second contact means would then be provided on an inner surface of the insulating sleeve within the movable member for activating the second sensor means. Means responsive to activation of the sensor means can be provided for indicating when the reciprocal member is in the first position and/or the second position.

Although not so limited in the application, the proximity switch disclosed in the present invention is adapted for use in power actuated clamps of the general type shown in my prior U.S. Pat. No. 4,396,183 in which a clamping arm is driven in movement between a closed workpiece clamping position and an open position by a piston rod of a fluid pressure actuated motor. In a typical power actuated clamp, the clamp assembly includes a housing adapted to be mounted on a fixed frame and a piston rod disposed to be reciprocated by pressurized fluid within the housing. A clamping arm is pivotally mounted on the housing and coupled to the piston rod by a link such that straight-line movement of the piston rod drives the clamping arm in pivotal movement between the clamp-open and clamp-closed positions.

Other advantages and applications of the present invention will become apparent to those skilled in the art when the following description of the best mode contemplated for practicing the invention is read in conjunction with the accompanying drawings.

BRIEF DESCRIPTION OF THE DRAWING

The description herein makes reference to the accompanying drawing wherein like reference numerals refer to like parts throughout the several views, and wherein.

DESCRIPTION OF THE PREFERRED EMBODIMENT

Figure 1:
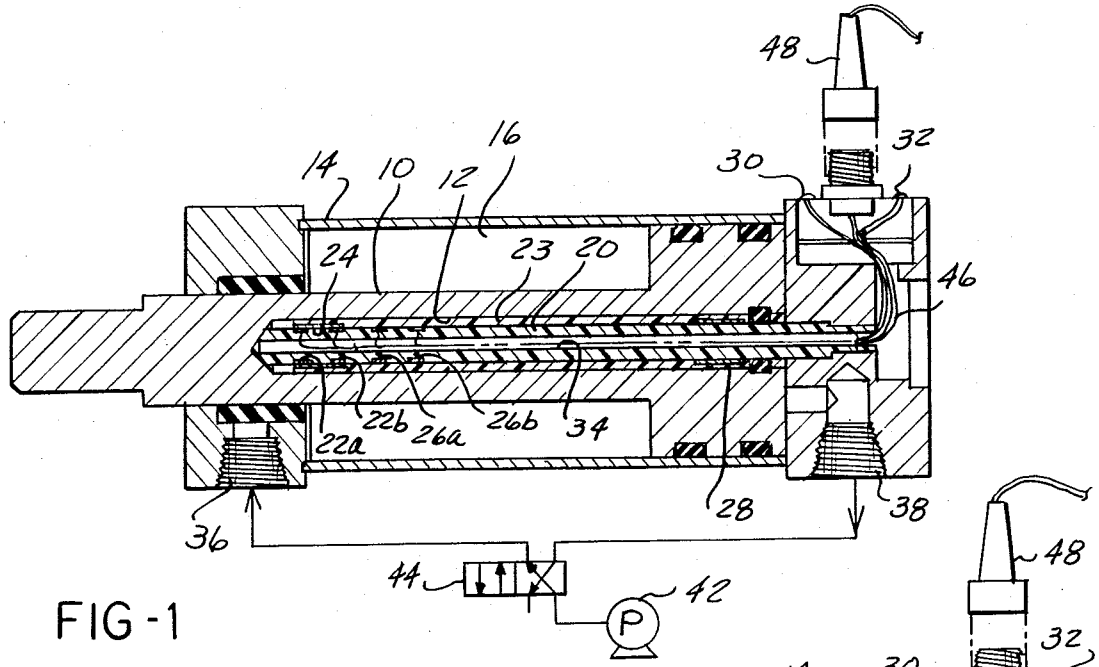
FIG. 1 is a sectional view of a cylinder according to the present invention with a movable member in a first position.

The present invention is similar in may respects to my prior copending patent application Ser. No. 141,552 filed Jan. 7, 1988 which is hereby incorporated by reference in its entirety herein. The present invention includes a movable member 10, such as a piston and attached rod, traveling along a fixed path between a first position and a second position. The movable member 10 includes an aperture 12 extending from one end parallel to the fixed path toward the other end of the movable member 10. A housing 14 encloses a portion of the movable member 10 to form a first expansible fluid chamber 16 between one end of the housing 14 and the movable member 10, and forming a separate second exapnsible fluid chamber 18 between another end of the housing 14 and the movable member 10. Expansion of the first fluid chamber 16 drives the movable member 10 to the first position, and expansion of the second fluid chamber 18 drives the movable member 10 to the second position. A sensor-supporting member 20 is connected to one end of the housing 14 and extends parallel to the path of travel of the movable member 10 toward the other end of the housing 14. The sensor-supporting member 20 is sheathed within an electrically insulated sleeve 23 fixedly disposed, such as by compressive interference fit or other means of securement well known to the art, in the aperture 12 of the movable member 10. First sensor means are mounted on a non-electrically conductive portion of the sensor-supporting member 20 for sensing the movable member 10 in the first position. The non-electrically conductive sleeve 23 is disposed within aperture 12 of the movable member 10 preventing electrical contact between the sensor means and the movable member 10 over at least a portion of the longitudinal length of the aperture. First contact means 24 are provided on an inner surface of the sleeve 23 within the movable member 10 for activating the first sensor means. Means, responsive to activation of the first sensor means, such as indicating light 30, is provided for indicating when the reciprocal member is in the first position. A passageway 34 within the sensor-supporting member 20 provides for wires 46 to interconnect the sensor means with the indicating means. Power is supplied through a connectable cap 48, which can also be used to transmit an indicating signal to a remote location.

If signaling of the movable member 10 in the second position is required, second sensor means can be mounted on the non-electrically conductive portion of sensor-supporting member 20 for sensing the movable member 10 in the second position. Second contact means 28 are then provided on the inner surface of the sleeve 23 within the movable member 10 for activating the second sensor means. Second means, responsive to activation of the second sensor means, such as indicating light 32, is provided for signaling when the movable member 10 is in the second position. Means 40 for sealing the aperture 12 within the movable member 10 from communicating with the second expansible fluid chamber 18 can be provided to prevent detrimental contact of the fluid with the first sensor means and/or the second sensor means.

A first fluid passage means 36 is provided for communicating fluid with the first expansible fluid chamber 16. A second fluid passage means 38 is provided at the opposite end of the housing 14 for communicating fluid with the second expansible fluid chamber 18. Means are provided for moving the movable member 10 between the first and second positions, such as fluid pump 42 and directional valve 44.

Figure 3:
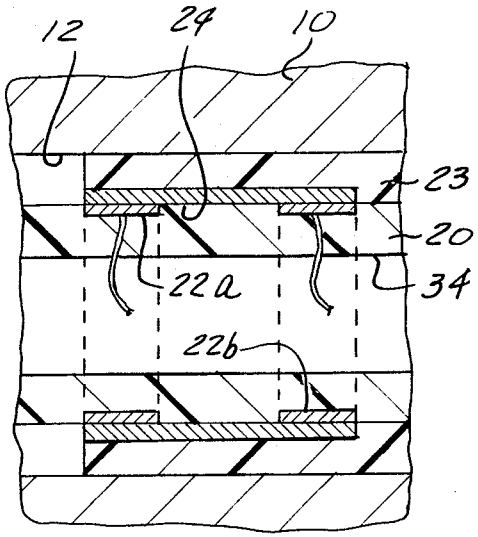
FIG. 3 is a detail view of the sensor means and activating means.

In a preferred embodiment, the present position sensing switch assembly is used in combination with a fluid pressure cylinder having a piston member slidably disposed in the cylinder for movement along a fixed path relative to the cylinder between a first end limit of movement and a second end limit of movement. The present invention of the position sensing switch assembly includes the piston member 10 having a longitudinal aperture 12 extending from a face of the piston member 10 on one end toward another end of the piston member 10. Insulating means 23 can include, such configurations as an electrically insulating sleeve, fixedly disposed within the aperture 12 along substantially an entire longitudinally length of the aperture 12, or a non-electrically conductive surface disposed longitudinally along at least a portion of the aperture 12 or an insulating air gap formed between the sensor supporting member and the piston member by an enlarged portion of the aperture 12 longitudinally along at least a portion of the aperture. The insulating means is provided for preventing electrical connection between the switch elements discussed below along the longitudinal length of the aperture, except for when the piston member has reached the position to be sensed. A first contact means, such as a first electrically conductive annular sleeve 24, is disposed within the insulating sleeve 23 adjacent one end, and second contact means, such as a second electrically conductive annular sleeve 26 is disposed within the insulating sleeve 23 adjacent another end opposite from the first sleeve 24. A sensor-supporting member 20 is connected to a wall of the cylinder opposing the piston face and extends outwardly from the wall of the cylinder. The sensor-supporting member 20 is engaged within the insulating sleeve 23 inside the aperture 12 of the piston member 10. The insulating sleeve 23 prevents electrical contact between the sensor means carried on the sensor-supporting member 20 and the piston member 10 over at least a portion of the longitudinal length of the aperture 12. A first pair of spaced annular electrically conductive position-sensing switch elements **22*a*, 22*b* are disposed on the sensor-supporting member 20 and are electrically insulated from one another while electrically insulated from the piston member 10 by the insulating sleeve 23. The first pair of switch elements 22*a*, 22*b* are engageable with the first electrically conductive annular sleeve 24 to complete a first electrical switch circuit for sensing the piston member 10 in the first end limit position. A second pair of spaced annular electrically conductive position-sensing switch elements 26*a*, 26*b* are disposed on the sensor-supporting member 20 and electrically insulated from one another while electrically insulated from the piston member 10 by the insulating sleeve 23. The second pair of switch elements 26*a*, 26*b* are engageable with the second electrically conductive annular sleeve 28 to complete a second electrical switch circuit for sensing the piston member 10 in the second end limit position. As can best be seen in FIG. 3, perferably, the contact means carried by the piston member 10 within the aperture 12 are electrically insulated from the piston member 10 by the insulating means 23**.

Figure 2:
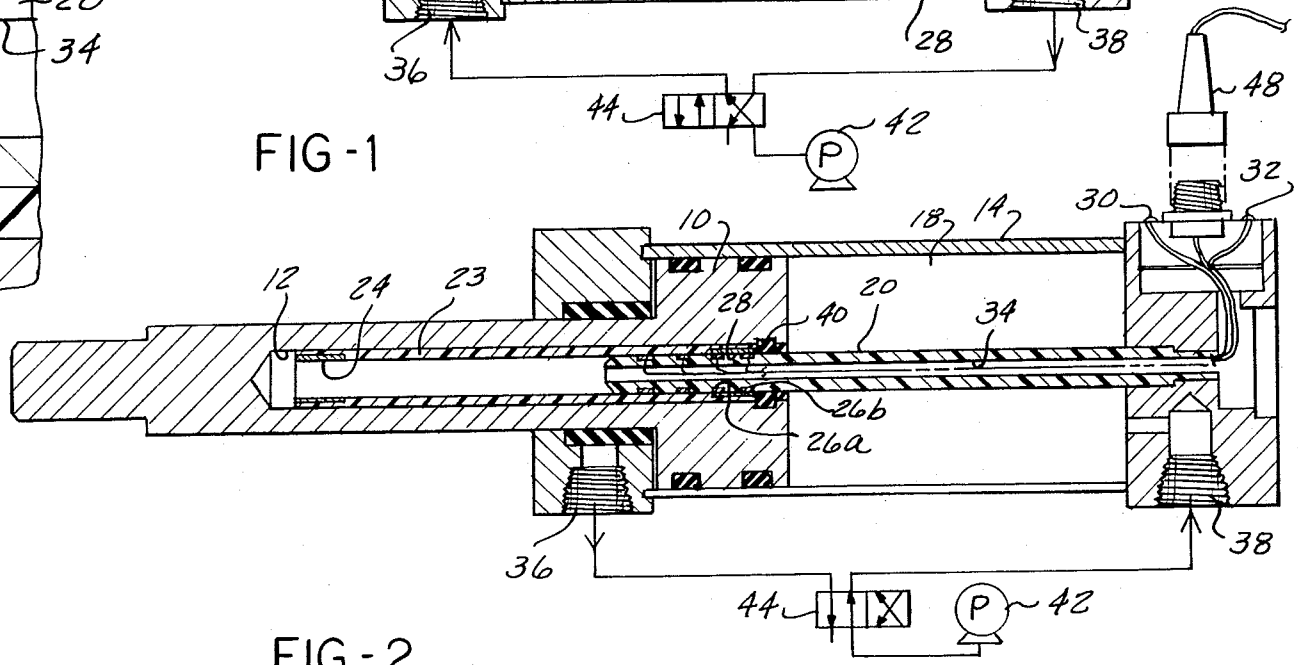
FIG. 2 is a sectional view with the movable member in a second position.

In operation, pressurized fluid is supplied by fluid pump 42 through directional valve 44 and first fluid passage means 36 to expand the first fluid chamber 16, driving the movable member 10, such as the piston and attached rod shown in FIG. 1, toward the first position or first end limit, wherein the piston is in the retracted position. Upon reaching the first position, the first contact means 24 preferably comprising an elongated annular electrically conductive contact disposed on an inner surface of the sleeve 23 adjacent one end of the movable member 10 engages the spaced annular electrically conductive switch elements **22*a*, 22*b* to activate the first sensor means or first switch, which illuminates indicating light 30. Shifting directional valve 44 to the position shown in FIG. 2 allows pressurized fluid from fluid pump 42 to enter the second fluid chamber 18 through the second fluid passage means 38, thereby causing the second fluid chamber to expand while the first fluid chamber retracts, discharging fluid through the first fluid passageway 36. Expansion of the second fluid chamber 18 moves the movable member 10 toward the second position, such as the second end limit or the extended position of the piston and attached rod shown in FIG. 2. As the piston moves from the first position to the second position, the first contact means 24 disengages from the switch elements 22*a*, 22*b* to extinguish indicating light 30. As the movable member 10 reaches the second position, the second contact means 28 preferably comprising a second elongated annular electrically conductive contact disposed on the inner surface of the sleeve 23 adjacent the other end of the movable member 10 engages or completes the electrical circuit of the spaced annular electrically conductive element 26*a*, 26*b* to activate second sensor means or second switch. The engagement of the second switch illuminates the second indicating light 32. The seal 40 prevents pressurized fluid, such as hydraulic fluid or compressed air, from entering into the aperture 12 of the movable member 10**. The reciprocating movement of the piston rod extending externally to the housing can be adapted for numerous uses, wherein the indicating or signaling of the fully extended position and/or retracted position of the piston is required, such as to drive a clamping arm in movement between a closed workpiece clamping position and an open position as disclosed in my prior U.S. Pat. No. 4,396,183.

While the invention has been described in detail, it will be apparent to those skilled in the art that the disclosed invention may be modified. Therefore, the foregoing description is to be considered exemplary, rather than limiting, and the true scope of the invention is that defined in the following claims.

The invention claimed is:

1. A proximity switch comprising:

a movable member traveling along a fixed path between a first position and a second position, said movable member having an aperture extending parallel to the fixed path from one end of the movable member toward another end of the movable member;

a housing enclosing a portion of the movable member to form a first expansible fluid chamber between a first end of the housing and the movable member, and forming a separate second expansible fluid chamber between a second end of the housing and the movable member, wherein expansion of the first fluid chamber drives the movable member to the first position and expansion of the second fluid chamber drives the movable member to the second position;

a sensor-supporting member connected to one end of the housing and extending parallel to the fixed path toward another end of the housing, said sensor-supporting member having a non-electrically conductive portion engaged within the aperture of the movable member;

separate fixed sensor means mounted on the non-electrically conductive portion of the sensor-supporting member said respective sensor means being electrically insulated from each other within said aperture; and electrically conductive contact means within the aperture of the movable member and movable therewith to bridge the respective sensor means when in the first position.

2. The switch of claim 1, further comprising means, responsive to activation of the sensor means, for indicating when the movable member is in the first position.

3. The switch of claim 1, further comprising second sensor means mounted on the non-electrically conductive portion of the sensor-supporting member for sensing the movable member in the second position; and second electrically conductive contact means within the aperture of the movable member and movable therewith for activating the second sensor means.

4. The switch of claim 3, further comprising second means, responsive to activation of the second sensor means, for indicating when the movable member is in the second position.

5. The switch of claim 1, further comprising a non-electrically conductive surface disposed longitudinally along at least a portion of the aperture.

6. The switch of claim 1, further comprising a non-electrically conductive sleeve disposed within the aperture to electrically insulate the sensor means from the movable member longitudinally along at least a portion of the aperture.

7. A proximity switch comprising:

a movable member having a first end, a second end and an aperture extending from the first end toward the second end, said movable member traveling along a fixed apth between a first position and a second position;

a non-electrically conductive surface disposed longitudinally along at least a portion of the aperture;

a housing having a first end and a second end, said housing enclosing the first end of the movable member with said second end of said movable member extending outwardly from said second end of said housing, said housing forming a first fluid chamber between said first end of said housing and said movable member and forming a second fluid chamber separate from said first fluid chamber between said second end of said housing and said movable member, wherein expansion of said first fluid chamber drives said movable member to said first position and expansion of said second fluid chamber drives said movable member to said second position;

a sensor-supporting member having a first end connected to the first end of said housing and a second end extending outwardly from said first end of said housing toward said second end of said housing, said sensor-supporting member having an electrically insulated portion engaged within said aperture of said movable member;

separate fixed sensor means mounted adjacent said second end of said sensor-supporting member on the electrically insulated portion of the sensor-supporting member said respective sensor means being electrically insulated from each other within said aperture; and electrically conductive contact means carried by the movable member within the aperture and movable therewith to bridge the respective sensor means when in the first position.

8. The switch of claim 7, further comprising means connected to said sensor means for indicating when said movable member is in said first position.

9. The switch of claim 7, further comprising second sensor means mounted toward the second end of the sensor-supporting member on the electrically insulated portion of the sensor-supporting member for sensing said second position of said movable member and second electrically conductive contact means carried by the movable member within the aperture for activating the second sensor means.

10. The switch of claim 9, further comprising second means connected to said second sensor means for indicating when said movable member is in said second position.

11. The switch of claim 7, further comprising means for sealing said aperture within said movable member.

12. The switch of claim 7, further comprising a non-electrically conductive sleeve disposed within said aperture along at least a portion of the aperture to electrically insulate the sensor means from the movable member along said portion of the aperture.

13. A position sensing switch assembly in combination with a fluid pressure cylinder having a movable piston member slidably disposed in said cylinder for movement along a fixed path relative to said cylinder between a first end limit of movement and a second end limit of movement, comprising:

said piston member having a longitudinal aperture extending from a face of said piston member on one end toward another end of said piston member;

a first electrically conductive surface on said piston member within said aperture adjacent said other end of said piston member;

a sensor-supporting member connected to a wall of said cylinder opposing said piston face, said sensor-supporting member extending outwardly from said wall of said cylinder and engaged within said aperture of said piston member; and said sensor supporting member having a first pair of spaced annular position-sensing conduction switch elements electrically insulated from one another and electrically insulated from the piston member longitudinally along at least a portion of the aperture, said first pair of switch elements bridged by said first electrically conductive surface within said aperture for sensing said reciprocal piston member in said first end limit position.

14. The switch of claim 13, further comprising:

a second electrically conductive surface on said piston member within said aperture adjacent said piston face; and said sensor supporting member having a second pair of spaced annular position-sensing conduction switch elements electrically insulated from one another and electrically insulated from the piston member longitudinally along at least a portion of the aperture, said second pair of switch elements engageable with said second electrically conductive surface within said aperture for sensing said reciprocal piston member in said second end limit position.

15. The switch of claim 14, further comprising means, responsive to activation of said first and second pair of position-sensing switches elements, for indicating when the reciprocal piston member is in the first end limit position and the second end limit position.

16. The switch of claim 13, further comprising:

a non-electrically conductive surface disposed along at least a portion of the aperture to electrically insulate the position-sensing switch elements from said piston member.

17. The switch of claim 13, further comprising:

a non-electrically conductive sleeve fixedly disposed along at least a portion of the aperture to electrically insulate the position-sensing switch elements from said piston member.

18. A position sensing switch assembly in combination with a fluid pressure cylinder having a piston member slidably disposed in said cylinder for movement along a fixed path relative to said cylinder between a first end limit of movement and a second end limit of movement comprising:

said piston member having a longitudinal aperture extending from a face of said piston member on one end toward another end of said piston member;

an electrically insulating sleeve fixedly disposed within said aperture along substantially the entire longitudinal length of the aperture;

a first electrically conductive annular sleeve disposed within the insulating sleeve adjacent one end;

a second electrically conductive annular sleeve disposed within the insulating sleeve adjacent another end opposite from said first sleeve;

a sensor-supporting member connected to a wall of said cylinder opposing said piston face, said sensor-supporting member extending outwardly from said wall of said cylinder and engaged within said insulating sleeve inside said aperture of said piston member;

a first pair of spaced annular electrically conductive position-sensing switch elements disposed on said sensor-supporting member and electrically insulated from one another while electrically insulated from the piston member by said insulating sleeve, said first pair of switch elements engageable with said first sleeve to complete a first electrical switch circuit for sensing the piston member in said first end limit position; and a second pair of spaced annular electrically conductive position-sensing switch elements disposed on said sensor-supporting member and electrically insulated from one another while electrically insulated from the piston member by said insulating sleeve, said second pair of switch elements engageable with said second sleeve to complete a second electrical switch circuit for sensing the piston member in said second end limit position.

* * * * *